US010247518B2

(12) United States Patent
McNeil et al.

(10) Patent No.: US 10,247,518 B2
(45) **Date of Patent: *Apr. 2, 2019**

(54) INTERACTIVE WEAPON TARGETING SYSTEM DISPLAYING REMOTE SENSED IMAGE OF TARGET AREA

(71) Applicant: AeroVironment, Inc., Monrovia, CA (US)

(72) Inventors: John C. McNeil, Tujunga, CA (US); Earl Clyde Cox, La Cresenta, CA (US); Makoto Ueno, Simi Valley, CA (US); Jon Andrew Ross, Moorpark, CA (US)

(73) Assignee: AEROVIRONMENT, INC., Monrovia, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/730,250

(22) Filed: Oct. 11, 2017

(65) Prior Publication Data

US 2018/0094902 A1 Apr. 5, 2018

Related U.S. Application Data

(63) Continuation of application No. 14/530,486, filed on Oct. 31, 2014, now Pat. No. 9,816,785.

(60) Provisional application No. 61/898,342, filed on Oct. 31, 2013.

(51) Int. Cl.

| | |
|---|---|
| ***F41G 5/14*** | (2006.01) |
| ***F41G 3/02*** | (2006.01) |
| ***F41G 3/14*** | (2006.01) |
| ***F41G 3/16*** | (2006.01) |

(52) U.S. Cl.
CPC ..... *F41G 5/14* (2013.01); *F41G 3/02* (2013.01); *F41G 3/142* (2013.01); *F41G 3/165* (2013.01)

(58) Field of Classification Search
CPC ... F41G 5/14; F41G 3/02; F41G 3/142; F41G 3/165
USPC .. 89/41.05, 41.01, 41.03, 41.18, 41.21, 203; 235/407; 348/144; 244/63; 701/2, 501
See application file for complete search history.

(56) References Cited

U.S. PATENT DOCUMENTS

| | | | | |
|---|---|---|---|---|
| 8,275,544 | B1 * | 9/2012 | Wells | G01C 21/165 342/146 |
| 8,408,115 | B2 | 4/2013 | Barger | |
| 9,696,430 | B2 * | 7/2017 | Park | G01S 19/39 |
| 2010/0017046 | A1 * | 1/2010 | Cheung | G01S 7/003 701/2 |
| 2011/0144828 | A1 * | 6/2011 | Chengalva | F41H 7/005 701/2 |
| 2011/0315817 | A1 * | 12/2011 | Miralles | B64C 39/024 244/63 |

(Continued)

OTHER PUBLICATIONS

International Search Report for PCT/US14/63537, dated Mar. 11, 2015.

(Continued)

*Primary Examiner* — John Cooper
(74) *Attorney, Agent, or Firm* — Brooks Acordia IP Law, PC; Pejman Yedidsion; Eric Aagaard

(57) ABSTRACT

Systems, devices, and methods for determining a predicted impact point of a selected weapon and associated round based on stored ballistic information, provided elevation data, provided azimuth data, and provided position data.

20 Claims, 12 Drawing Sheets

(56) References Cited

U.S. PATENT DOCUMENTS

| | | | | |
|---|---|---|---|---|
| 2012/0105634 | A1* | 5/2012 | Meidan | G08B 13/1965 348/143 |
| 2012/0145786 | A1* | 6/2012 | Weaver | F41G 3/06 235/407 |
| 2013/0021475 | A1* | 1/2013 | Canant | H04N 5/33 348/144 |

OTHER PUBLICATIONS

Non-Final Office action for U.S. Appl. No. 14/530,486 dated Apr. 5, 2017.
Notice of Allowance for U.S. Appl. No. 14/530,486 dated Sep. 25, 2017.
Notice of Allowance for U.S. Appl. No. 14/530,486 dated Sep. 8, 2017.
Restriction Requirement for U.S. Appl. No. 14/530,486 dated Dec. 2, 2016.
Restriction Requirement for U.S. Appl. No. 14/530,486 dated Jul. 14, 2016.
Written Opinion for Singapore Application No. 11201603140W dated Mar. 1, 2017.
Li Bing, Liu Rongyuan, Liu Suhong, eta!. Monitoring vegetation coverage variation of winter wheat by low-altitude UAVremotesensing system[J]. Transactions of the Chinese Society of Agricultural Engineering (Transactions of the CSAE), 2012, 28(13):160-165. (in Chinese with English abstract).

* cited by examiner

INTERACTIVE WEAPON TARGETING SYSTEM DISPLAYING REMOTE SENSED IMAGE OF TARGET AREA

CROSS-REFERENCE TO RELATED APPLICATIONS

This application is a continuation of U.S. Non-provisional patent application Ser. No. 14/530,486 filed Oct. 31, 2014 that claims priority to and the benefit of U.S. Provisional Patent Application No. 61/898,342, filed Oct. 31, 2013, the contents of which all are hereby incorporated by reference herein for all purposes.

TECHNICAL FIELD

Embodiments relate generally to systems, methods, and devices for weapon systems and Unmanned Aerial Systems (UAS), and more particularly to displaying remote sensed images of a target area for interactive weapon targeting.

BACKGROUND

Weapon targeting has typically been performed by a gun operator firing the weapon. Weapon targeting systems and fire-control systems for indirect fire weapons do not provide the operator with direct view of the target.

SUMMARY

A device is disclosed that includes a fire control controller, an inertial measurement unit in communication with the fire control controller, the inertial measurement unit configured to provide elevation data to the fire control controller, a magnetic compass in communication with the fire control controller, the magnetic compass operable to provide azimuth data to the fire control controller, a navigation unit in communication with the fire control controller, the navigation unit configured to provide position data to the fire control controller, and a data store in communication with the fire control controller, the data store having ballistic information associated with a plurality of weapons and associated rounds, so that the fire control controller determines a predicted impact point of a selected weapon and associated round based on the stored ballistic information, the provided elevation data, the provided azimuth data, and the provided position data. In one embodiment, the fire control controller may receive image metadata from a remote sensor, wherein the image metadata may include ground position of a Center Field of View (CFOV) of the remote sensor, and wherein the CFOV may be directed at the determined predicted impact point. The fire control controller may determine an icon overlay based on the received image metadata from the remote sensor, wherein the icon overlay may include the position of the CFOV and the determined predicted impact point. The fire control controller may also determine the predicted impact point based further on predicting a distance associated with a specific weapon, wherein the distance may be the distance between a current location of the rounds of the weapon and a point of impact with the ground. Embodiments may also include a map database configured to provide information related to visual representation of terrains of an area to the fire control controller to determine the predicted impact point and the fire control controller may also determine the predicted impact point based further on the map database information.

In another embodiment, the device also includes an environmental condition determiner configured to provide information related to environmental conditions of the surrounding areas of the predicted impact point in order for the fire control controller to determine the predicted impact point. In such an embodiment, the fire control controller may determine the predicted impact point based further on the environmental condition information so that the fire control controller is further configured to communicate with an electromagnetic radiation transceiver, the transceiver configured to transmit and receive electromagnetic radiation. The electromagnetic radiation transceiver may be a radio frequency (RF) receiver and RF transmitter. In an alternative embodiment, the electromagnetic radiation transceiver may be further configured to receive video content and image metadata from a remote sensor, and the remote sensor may transmit the image metadata via a communication device of a sensor controller on an aerial vehicle housing the remote sensor. The remote sensor may be mounted to the aerial vehicle, and the electromagnetic radiation transceiver may be further configured to transmit information to the sensor controller of the aerial vehicle. The fire control controller may transmit information that includes the determined predicted impact point to the sensor controller of the aerial vehicle to direct the pointing of the remote sensor mounted to the aerial vehicle.

In other embodiments, a ballistic range determiner may be configured to determine the predicted impact point based on the weapon position, azimuth, elevation, and round type. Also, the data store may be a database, the database including at least one of a lookup table, one or more algorithms, and a combination of a lookup table and one or more algorithms. The position determining component may also include at least one of: a terrestrially based position determining component; a satellite based position determining component; and a hybrid of terrestrially and satellite based position determining devices. The fire control controller is in communication with a user interface, the user interface including at least one of: a tactile responsive component; an electromechanical radiation responsive component; and an electromagnetic radiation responsive component, and the user interface may be configured to: receive a set of instructions via the user interface and transmit the received set of instructions to the fire control controller.

In another embodiment, the device may also include an instruction creating component having at least one of a user interface configured to identify and record select predefined activity occurring at the user interface, and a communication interface in communication with a remote communication device, the remote communication device configured to direct a remote sensor via a sensor controller; so that a user at the user interface requests the remote sensor to aim at an anticipated weapon targeting location. The instruction creating component may be in communication with an aerial vehicle housing the remote sensor to transmit instructions to the aerial vehicle to keep a weapon targeting location in the view of the remote sensor.

A remote targeting system is also disclosed that includes a weapon, a display on the weapon, a radio frequency (RF) receiver, a sensor remote from the weapon, wherein the sensor is configured to provide image metadata of a predicted impact point on the weapon display, and a targeting device that itself includes a data store having ballistic information associated with a plurality of weapons and associated rounds and a fire control controller wherein the fire control controller determines a predicted impact point based on the ballistic information, elevation data received from an inertial measurement unit, azimuth data received from a magnetic compass, position data received from a position determining component, wherein the fire control controller is in communication with the inertial measurement unit, the magnetic compass, and the position determining component. The remote sensor may be mounted to an unmanned aerial vehicle. The targeting system may determine a position and orientation of the weapon and further uses a ballistic lookup table to determine the predicted impact point of the weapon. The remote sensor may receive the predicted impact point of the weapon and aim the sensor at the predicted impact point of the weapon. The system further may also include a second weapon, a second display on the second weapon, and a second targeting device, so that the predicted impact point on the weapon display provided by the remote sensor is the same as the predicted image location on the second weapon display. In one embodiment, the second weapon has no control over the remote sensor. Also, the second weapon may not send any predicted impact point information of the second weapon to the remote sensor. The determined predicted impact point of the weapon may be different than a determined predicted impact point of the second weapon. The sensor may be an optical camera configured to provide video images to the remote targeting system for display on the weapon display.

BRIEF DESCRIPTION OF THE DRAWINGS

Embodiments are illustrated by way of example and not limitation in the figures of the accompanying drawings, and in which.

DETAILED DESCRIPTION

Weapon targeting systems are disclosed herein where the systems may have a gun data computer or ballistic computer, a fire control controller, a communication device, and optionally an object-detection system or radar, which are all designed to aid the weapon targeting system in hitting a determined target faster and more accurately. The exemplary weapon targeting system embodiments may display remote sensed images of a target area for interactive weapon targeting and accurately aim the weapon rounds at the target area. One embodiment may include an Unmanned Aerial System (UAS), such as an Unmanned Aerial Vehicle (UAV). The UAV may be a fixed wing vehicle or may have one or more propellers connected to a chassis in order to enable the UAV to hover in a relatively stationary position. Additionally, the UAV may include a sensor, where the sensor is remote to the weapon targeting system, and the sensor may be an image capture device. The sensor may be aimed so as to have a viewing range of an area about an identified target. The sensor on the UAV may be moved by commands received from different origins, for example, the pilot of the UAV or a ground operator. The sensor may also be commanded to focus on a specific target on a continuous basis and based on direction received from a ground operator.

In one embodiment of the weapon targeting system, the system may be used for displaying to a user of a weapon, the weapon's target area, e.g., an area about where the determined or calculated weapon's impact may be, as viewed from a sensor remote from the weapon. This allows the user to view in real-time (or near real-time) the effect of the weapon within the target area and make targeting adjustments to the weapon. To aid in the aiming of the weapon, the display may indicate within the target area on the display, a determined or anticipated impact location, using an indicator, for example, a reticle, a crosshair, or an error estimation ellipse/region. The use of a remote sensor may allow targets to be engaged without a direct line of sight from the user to the target, for example, when the target is located behind an obstruction, such as a hill. The remote sensor may be any of a variety of known sensors which may be carried by a variety of platforms. In some embodiments, the sensor may be a camera mounted to an air vehicle that is positioned away from the weapon and within viewing range of the area about the target. Such an air vehicle may be a UAV such as a small unmanned aerial system (SUAS).

Figure 1:
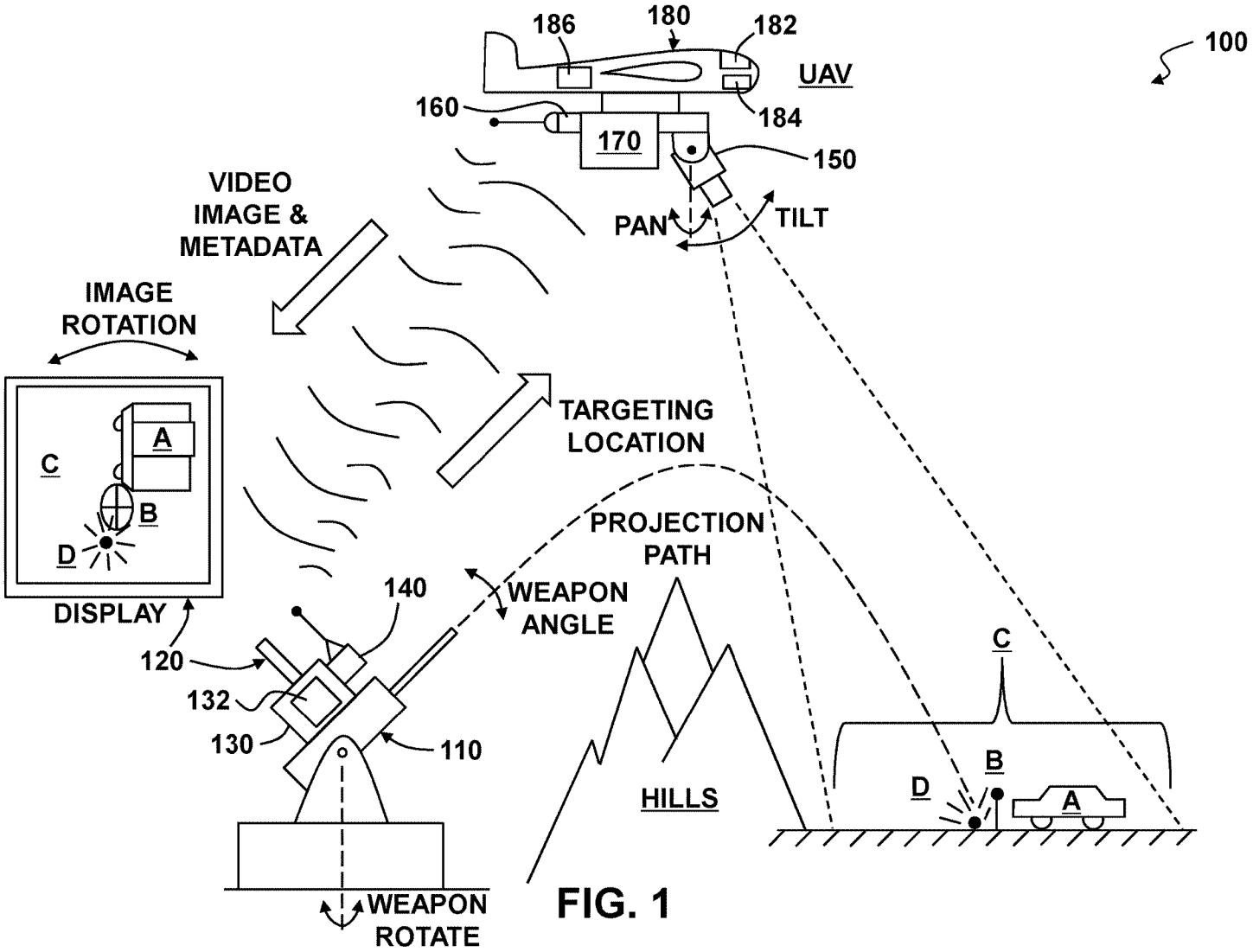
FIG. 1 is an exemplary embodiment of a weapon targeting system environment.

FIG. 1 depicts a weapon targeting system environment 100 having a weapon 110, a display 120, a targeting device 130, a communication device 140, a remote sensor 150, a remote communication device 160, and a sensor controller 170. Also shown is a target A, an anticipated weapon effect or predicted targeting location B, the viewed target area C, and the actual weapon effect D. The weapon targeting system environment 100 may also include a set of obstructions, such as hills, a weapon mount for rotating the weapon, and an aerial vehicle 180 where the remote sensor 150, the remote communication device 160, and the sensor controller 170 may be mounted to.

The weapon 110 may be any of a variety of weapons, such as a grenade launcher, a mortar, an artillery gun, tank gun, ship gun, deck gun, or any other weapon that launches a projectile to impact a location of weapon effect. In some embodiments, the weapon 110 may be moving in order to allow it to be easily moved along with the gun and rounds associated with the weapon. The targeting device 130 may include an inertial measuring unit (IMU) that may include magnetometers, gyroscopes, accelerometers, as well as a magnetic compass and a navigation system, which may be a global positioning system (GPS), to determine the location and orientation of the weapon 110. As a user maneuvers or positions the weapon 110, the targeting device 130 may monitor the weapon's location thereby determining the direction the weapon is pointing (which may be a compass heading), the weapon's orientation, for example, the angle of the weapon relative to a local level parallel to the ground. Additionally, the targeting device may then, based on characteristics of the weapon and its projectiles, use a target determination means 132, such as a ballistic computer, lookup table, or the like, to provide a determined point of weapon effect. The point of weapon effect may be the expected projectile impact point, which may be an anticipated weapon effect location. The target determination means 132 may also reference a database or a map with elevation information to allow for a more accurate determination of the weapon effect or predicted targeting location B. The targeting location information may include longitude, latitude, and elevation of the location and may further include error values, such as weather conditions, about or near the targeting location.

In embodiments, the targeting device 130 may, for example, be a tablet computer having an inertial measurement unit, such as a Nexus 7 available from Samsung Group of Samsung Town, Seoul, South Korea (via Samsung Electronics of America, Ridgefield Park, N.J.), an iPad, available from Apple, Inc. of Cupertino, Calif., or a Nexus 7, available from ASUSTeK Computer Inc. of Taipei, Taiwan (via ASUS Fremont, Calif.).

The targeting location information relating to the targeting location B may then be sent, via the communication device 140, to the remote communication device 160 connected to the sensor controller 170, where the sensor controller 170 may direct the remote sensor 150. In one embodiment, the communication device 140 may send targeting information to the UAV Ground Control Station via the remote communication device 160, then the UAV Ground Control Station may send the targeting information back to the remote communication device 160 that may then forward it to the sensor controller 170. The remote sensor 150 may then be aimed to view the anticipated weapon targeting location B, which may include the adjacent areas around this location. The adjacent areas around this location are depicted in FIG. 1 as the viewed target area C. The control for aiming of the remote sensor 150 may be determined by the sensor controller 170, where the sensor controller 170 may have a processor and addressable memory, and which may utilize the location of the remote sensor 150, the orientation of the remote sensor 150—namely its compass direction—and the angle relative to level to determine where on the ground the sensor is aimed, which could be the image center, image boundary, or both the image center and image boundary. In one embodiment, the location of the remote sensor 150 may optionally be obtained from the UAV's onboard GPS sensors. In another embodiment, the orientation of the sensor, for example, compass direction and angle relative to level, may be determined by the orientation and angle to level of the UAV and the orientation and angle of the sensor relative to the UAV. In some embodiments, the sensor controller 170 may aim the sensor to the anticipated weapon targeting location B, and/or the viewed target area C. Optionally, the aiming of the remote sensor 150 by the sensor controller 170 may include the zooming of the sensor.

In embodiments, the communication device 140 may be connected to a Ground Control Station (GCS), for example, one available from AeroVironment, Inc. of Monrovia Calif. (http://www.avinc.com/uas/small_uas/gcs/) and may include a Digital Data Link (DDL) Transceiver bi-directional, digital, wireless data link, for example, available from AeroVironment, Inc. of Monrovia Calif. (http://www.avinc.com/uas/ddl/).

In some embodiments, the remote communication device 160 and the remote sensor 150 may be mounted on a flying machine, such as satellites or an aerial vehicle, whether manned aerial vehicle or unmanned aerial vehicle (UAV) 180 flying within viewing distance of the target area C. The UAV 180 may be any of a variety of known air vehicles, such as a fixed wing aircraft, a helicopter, a quadrotor, blimp, tethered balloon, or the like. The UAV 180 may include a location determining device 182, such as a GPS module and an orientation or direction determining device 184, such as an IMU and/or compass. The GPS 182 and the IMU 184, provide data to a control system 186 to determine the UAV's position and orientation, which in turn may be used with the anticipated weapon targeting location B to direct the remote sensor 150 to view the location B. In some embodiments, the sensor controller 170 may move, i.e., tilt, pan, zoom, the remote sensor 150 based on the received data from the control system 186 and the anticipated weapon targeting location received from the weapon targeting system.

In one embodiment, either the IMU 184 or the control system 186 may determine the attitude, i.e., pitch, roll, yaw, position, and heading, of the UAV 180. Once the determination is made, the IMU 184 (or system 186) using an input of Digital Terrain and Elevation Data (DTED) (stored on board the UAV in a data store, e.g., a database), may then determine where any particular earth-referenced grid position is located (such as location B), relative to a reference on the UAV, such as its hull. In this embodiment, this information may then be used by the sensor controller 170 to position the remote sensor 150 to aim at a desired targeting location relative to the UAV's hull.

In addition to pointing the camera at the targeting location B, if permitted by the operator of the UAV (VO), the UAV may also attempt to center an orbit on the targeting location B. The VO will ideally specify a safe air volume in which the UAV may safely fly based upon locations specified by the display on the gun. In some embodiments, the system may enable a gun operator to specify a desired 'Stare From' location for the UAV to fly if the actual location is not the desired targeting location to center the UAV's orbit. Additionally, the safe air volume may be determined based on receiving geographic data defining a selected geographical area and optionally, an operating mode associated with the selected geographical area, where the received operating mode may restrict flight by the UAV over an air volume that may be outside the safe air volume. That is, the VO may control the flight of the UAV based on the selected geographical area and the received operating mode. Accordingly, in one embodiment the weapon operator may be able to fully control the UAV's operation and flight path. Additionally, a ground operator or a pilot of the UAV may command the weapon and direct the weapon to point to a target based on the UAV's imagery data.

Commands from the weapon system to the UAV or to the sensor may be sent, for example, via any command language including Cursor on Target (CoT), STANAG 4586 (NATO Standard Interface of the Unmanned Control System—Unmanned Aerial Vehicle interoperability), or Joint Architecture for Unmanned Systems (JAUS).

The field of view of the remote sensor 150 may be defined as the extent of the observable area that is captured at any given moment in time. Accordingly, the Center Field of View (CFOV) of the sensor 150 may point at the indicated weapon targeting location B. The user may manually zoom in or zoom out on the image of the targeting location B to get the best view associated with the expected weapon impact site, including the surrounding target area and the target. The remote sensor 150 captures imagery data and the sensor controller 170, via the remote communication device 160, may transmit the captured data along with related metadata. The metadata in some embodiments may include other data related to and associated with the imagery being captured by the remote sensor 150. In one embodiment, the metadata accompanying the imagery may indicate the actual CFOV, for example, assuming it may still be slewing to the indicated location, as well as the actual grid positions of each corner of the image being transmitted. This allows the display to show where the anticipated weapon targeting location B is on the image, and draw a reticle, e.g., crosshair, at that location.

In some exemplary embodiments, the remote sensor 150 may be an optical camera mounted on a gimbal such that it may pan and tilt relative to the UAV. In other embodiments the sensor 150 may be an optical camera mounted in a fixed position in the UAV and the UAV is positioned to maintain the camera viewing the target area C. The remote sensor may be equipped with either optical or digital zoom capabilities. In one embodiment, there may be multiple cameras that may include Infra-Red or optical wavelengths on the UAV that the operator may optionally switch between. According to the exemplary embodiments, the image generated by the remote sensor 150 may be transmitted by the remote communication device 160 to a display 120 via the communication device 140. In one embodiment, data, such as image metadata, that provides information including the CFOV and each corner of the view as grid locations, e.g., the ground longitude, latitude, elevation of each point, may be transmitted with the imagery from the remote sensor 150. The display 120 may then display to the weapon user the viewed target area C which includes the anticipated weapon targeting location B which as shown in FIG. 1, may be a targeting reticle, as the CFOV. In some embodiments, the anticipated targeting location B may be shown separate from the CFOV, such as when the weapon 110 is being moved and the remote sensor 150 is slewing, e.g., tilting and/or yawing, to catch up to the new location B and re-center the CFOV at the new location. In this manner, as the user maneuvers the weapon 110, e.g., rotates, and/or angles the weapon, the user may see on the display 120 where the predicted targeting location B of the weapon 110 is as viewed by the remote sensor 150. This allows the weapon user to see the targeting location—and the target and weapon impacts—even without a direct line of sight from the weapon to the targeting location B, such as with the target positioned behind an obstruction.

In one embodiment, to aid the user, the image displayed may be rotated for the display to align with the compass direction so that the weapon is pointed or by some defined fixed direction, e.g., north is always up on the display. The image may be rotated to conform to the weapon user's orientation, regardless of the position of the UAV or other mounting of the remote sensor. In embodiments, the orientation of the image on the display is controlled by the bore azimuth of the gun barrel or mortar tube as computed by the targeting device, e.g., a fire control computer. In some embodiments, the display 120 may also show the position of the weapon within the viewed target area C.

In embodiments, the remote communication device 160, the remote sensor 150 and the sensor controller 170 may all be embodied, for example, in a Shrike VTOL that is a man-packable, Vertical Take-Off and Landing Micro Air Vehicle (VTOL MAV) system available from AeroVironment, Inc. of Monrovia Calif. (http://www.avinc.com/uas/small_uas/shrike/).

Additionally, some embodiments of the targeting system may include a targeting error correction. In one exemplary embodiment, air vehicle wind estimates may be provided as a live feed to be used with the round impact estimates and provide more accurate error correction. When the actual impact ground point of the weapon's round is displaced from the predicted impact ground point (GP), without changing the weapons position, the user on their display may highlight the actual impact GP and the targeting system may determine a correction value to apply to the determination of the predicted impact GP and then provide this new predicted GP to the remote sensor and display it on the weapon display. One embodiment of such is shown in FIG. 1, in the display 120, where the actual impact point D is offset from the predicted impact GP B. In this embodiment, the user may highlight the point D and input to the targeting system as the actual impact point which would then provide for a targeting error correction. Accordingly, the target impact point may be corrected via tracking the first round impact and then adjusting the weapon on the target. In another exemplary embodiment of the error correction or calibration, the system may detect an impact point using image processing on the received imagery that depicts the impact point before and upon impact. This embodiment may determine when a declaration may be made that impact has happened based on determining a computed time of flight associated with the rounds used. The system may then adjust the position based on the expected landing area for the rounds and last actual round that was fired.

Figure 2:
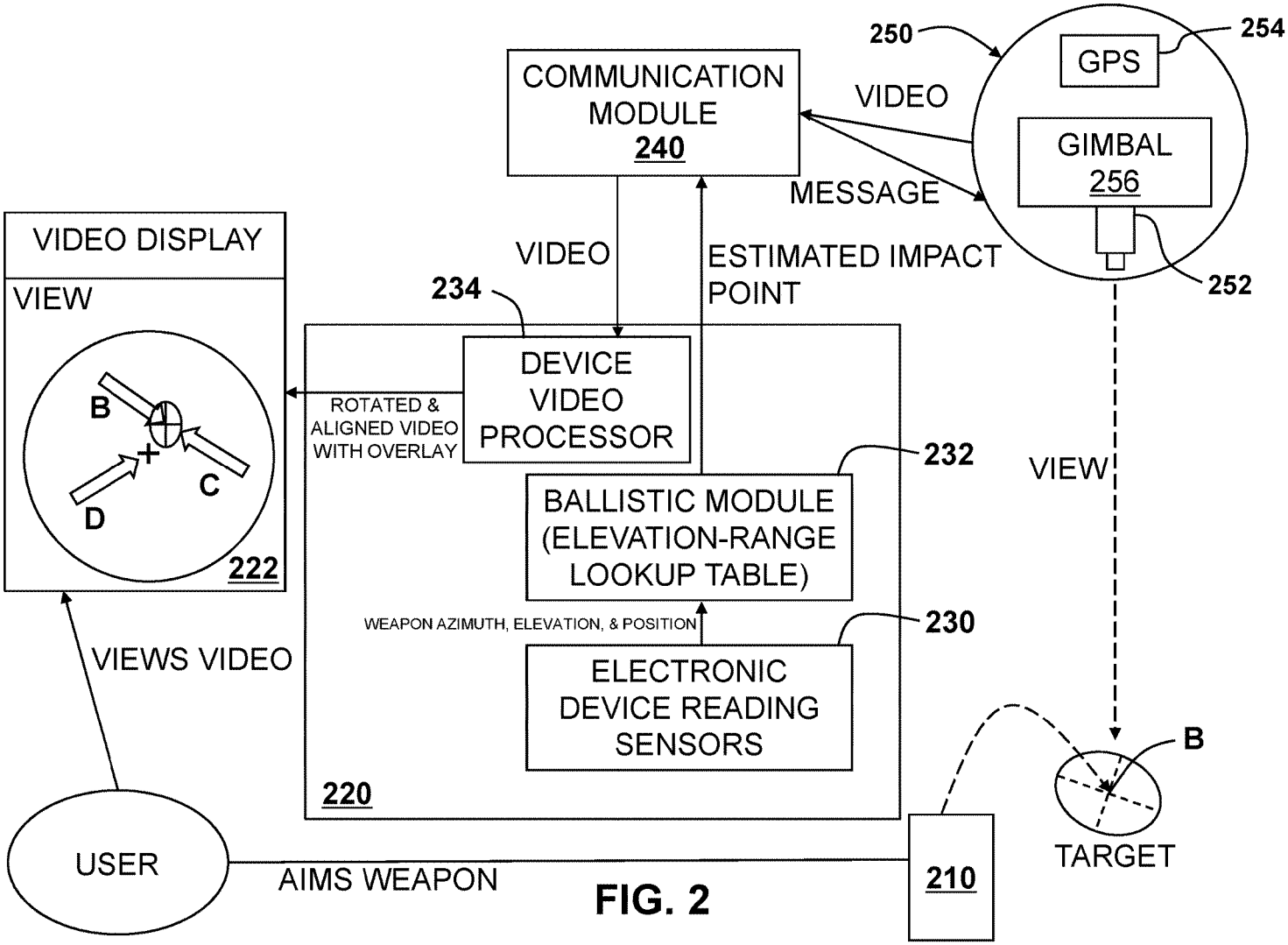
FIG. 2 is an exemplary embodiment of a system that includes a handheld or mounted gun or grenade launcher, with a mounted computing device, and an Unmanned Aerial Vehicle (UAV) with a remote sensor.

FIG. 2 depicts embodiments that include a handheld or mounted gun or grenade launcher 210, with a mounted computing device, e.g., a tablet computer 220, having a video display 222, an inertial measurement unit (IMU) 230, a ballistic range module 232, a communication module 240, and a UAV 250 with a remote sensor, e.g., an imaging sensor 252. The UAV 250 may further have a navigation unit 254, e.g., GPS, and a sensor mounted on a gimbal 256 such that the sensor 252 may pan and tilt relative to the UAV 250. The IMU 230 may use a combination of accelerometers, gyros, encoders, or magnetometers to determine the azimuth and elevation of the weapon 210. The IMU 230 may include a hardware module in the tablet computer 220, an independent device that measures attitude, or a series of position sensors in the weapon mounting device. For example, in some embodiments the IMU may use an electronic device that measures and reports on a device's velocity, orientation, and gravitational forces by reading the sensors of the tablet computer 220.

The ballistic range module 232 calculates the estimated or predicted impact point given the weapon position (namely latitude, longitude, and elevation), azimuth, elevation, and round type. In one embodiment, the predicted impact point may be further refined by the ballistic range module including in the calculations, wind estimates. The ballistic range module 232 may be a module in the tablet computer or an independent computer having a separate processor and memory. The calculation may be done by a lookup table constructed based on range testing of the weapon. The output of the ballistic range module may be a series of messages including the predicted impact point B (namely latitude, longitude, and elevation). The ballistic range module 232 may be in the form of non-transitory computer enabled instructions that may be downloaded to the tablet 220 as an application program.

The communication module 240 may send the estimated or predicted impact point to the UAV 250 over a wireless communication link, e.g., an RF link. The communication module 240 may be a computing device, for example, a computing device designed to withstand vibration, drops, extreme temperature, and other rough handling. The communication module 240 may be connected to or in communication with a UAV ground control station, or a Pocket DDL RF module, available from AeroVironment, Inc. of Monrovia, Calif. In one exemplary embodiment, the impact point message may be the "cursor-on-target" format, a geospacial grid, or other formatting of latitude and longitude.

The UAV 250 may receive the RF message and point the imaging sensor 252—remote to the weapon—at the predicted impact point B. In one embodiment, the imaging sensor 252 sends video over the UAV's RF link to the communication module 240. In one exemplary embodiment, the video and metadata may be transmitted in Motion Imagery Standards Board (MISB) format. The communication module may then send this video stream back to the tablet computer 220. The tablet computer 220, with its video processor 234, rotates the video to align with the gunner's frame of reference and adds a reticle overlay that shows the gunner the predicted impact point B in the video. The rotation of the video image may be done such that the top of the image that the gunner sees matches the compass direction that the gun 210 is pointing at, or alternatively the compass direction determined from the gun's azimuth, or compass direction between the target position and gun position.

In some embodiments, the video image being displayed on the video display 222 on the tablet computer 220 provided to the user of the weapon 210, may include the predicted impact point B and a calculated error ellipse C. Also shown on the video image 222 is the UAV's Center Field of View (CFOV) D.

In one embodiment, in addition to automatically directing the sensor or camera gimbal toward the predicted impact point, the UAV may also fly towards, or position itself about, the predicted impact point. Flying toward the predicted impact point may occur when the UAV is initially (upon receiving the coordinates of the predicted impact point) at a location where the predicted impact point is too distant to be seen, or to be seen with sufficient resolution by the UAV's sensor. In addition, with the predicted impact point, the UAV may automatically establish a holding pattern, or holding position, for the UAV, where such holding pattern/position allows the UAV sensor to be within observation range and without obstruction. Such a holding pattern may be such that it positions the UAV to allow a fixed side-view camera or sensor to maintain the predicted impact point in view.

Figure 3:
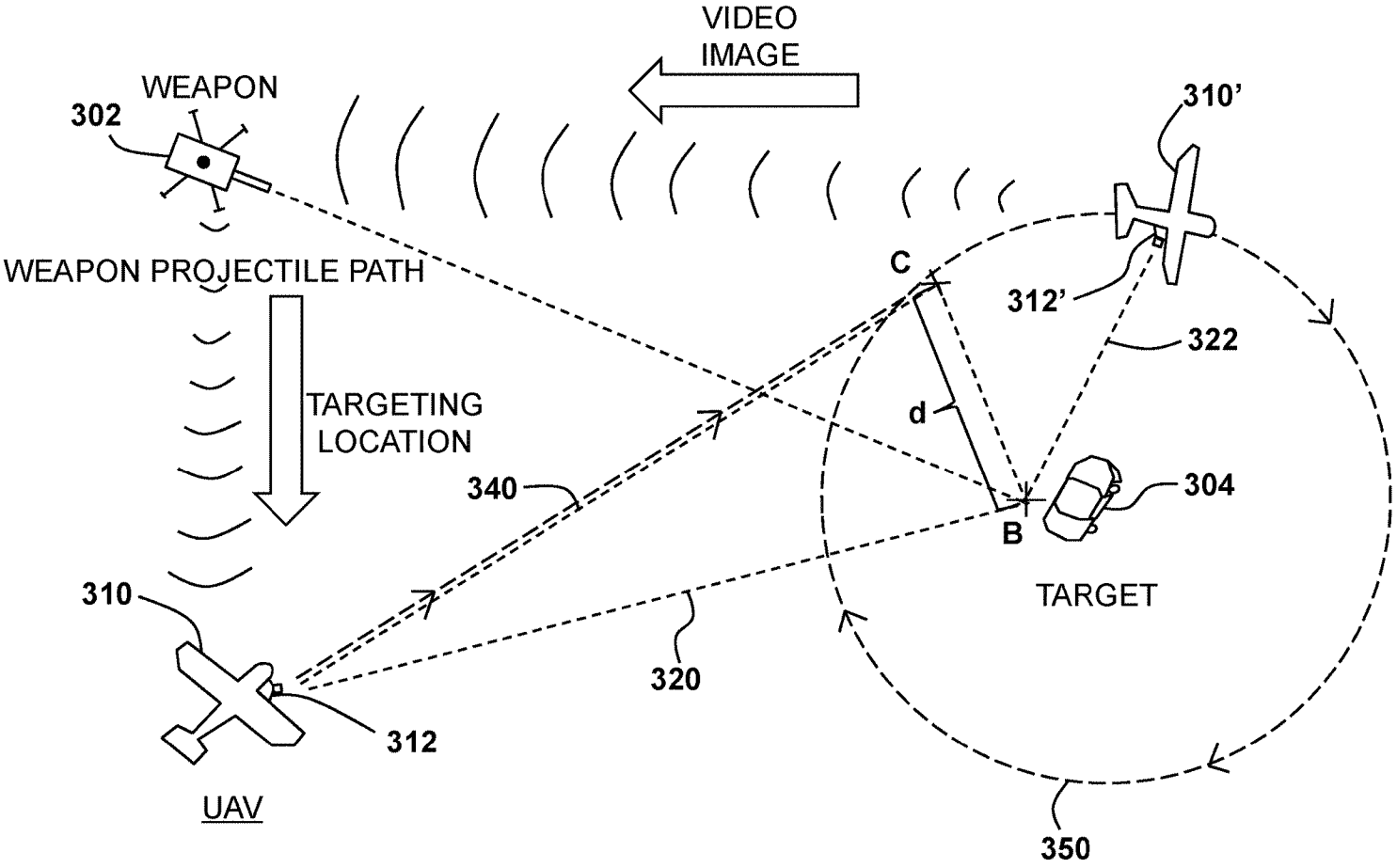
FIG. 3 shows a top view of a UAV with a remote sensor initially positioned away from a target and a predicted impact point of the weapon.

FIG. 3 shows a top view of the UAV 310 with a remote sensor 312 initially positioned away from a target 304 and the predicted impact point B of the weapon 302, such that the image produced by the sensor 312 of the predicted impact point B and the target area (presumably including the target 304), as shown by the image line 320, the sensor lacks sufficient resolution to provide sufficiently useful targeting of the weapon 302 for the user. As such, the UAV 310 may alter its course to move the sensor closer to the predicted impact point B. This alternation of course may be automatic when the UAV is set to follow, or be controlled by, the weapon 302, or the course alternation may be done by the UAV operator when requested or commanded by the weapon user. In one embodiment, retaining control of the UAV by the UAV operator allows for consideration of, and response to, factors such as airspace restrictions, UAV endurance, UAV safety, task assignment, and the like.

As shown in FIG. 3, the UAV executes a right turn and proceeds towards the predicted impact point B. In embodiments of the weapon targeting system, the UAV may fly to a specific location C—as shown by course line 340—that is a distance d away from the predicted impact point B. This move allows the sensor 312 to properly observe the predicted impact point B and to allow for targeting of the weapon 302 to the target 304. The distance d may vary and may depend on a variety of factors, including the capabilities of the sensor 312, e.g., zoom, resolution, stability, etc., capabilities of the display screen on the weapon 302, e.g., resolution, etc., user abilities to utilize the imaging, as well as factors such as how close the UAV should be positioned from the target. In this exemplary embodiment, the UAV upon reaching the location C may then position itself to be in a holding pattern or observation position 350 to maintain a view of the predicted impact point B. As shown, the holding pattern 350 is a circle about the predicted impact point B, other patterns also be used in accordance with these exemplary embodiments. With the UAV 310' in the holding pattern 350, the UAV may now continuously reposition its sensor 312' to maintain its view 322 of the predicted impact point B. That is, while the UAV is flying about the target, the sensor looks at or is locked on the predicted impact point location. In this embodiment, during the holding pattern time the UAV may transmit a video image back to the weapon 302. As the user of the weapon 302 repositions the aim of the weapon, the UAV may re-aim the sensor 312' and/or reposition the UAV 310' itself to keep the new anticipated weapon targeting location in the sensor's view. In an exemplary embodiment, the remote sensor may optionally be viewing the target, while guiding the weapon, so that the anticipated targeting location coincides with the target.

Figure 4:
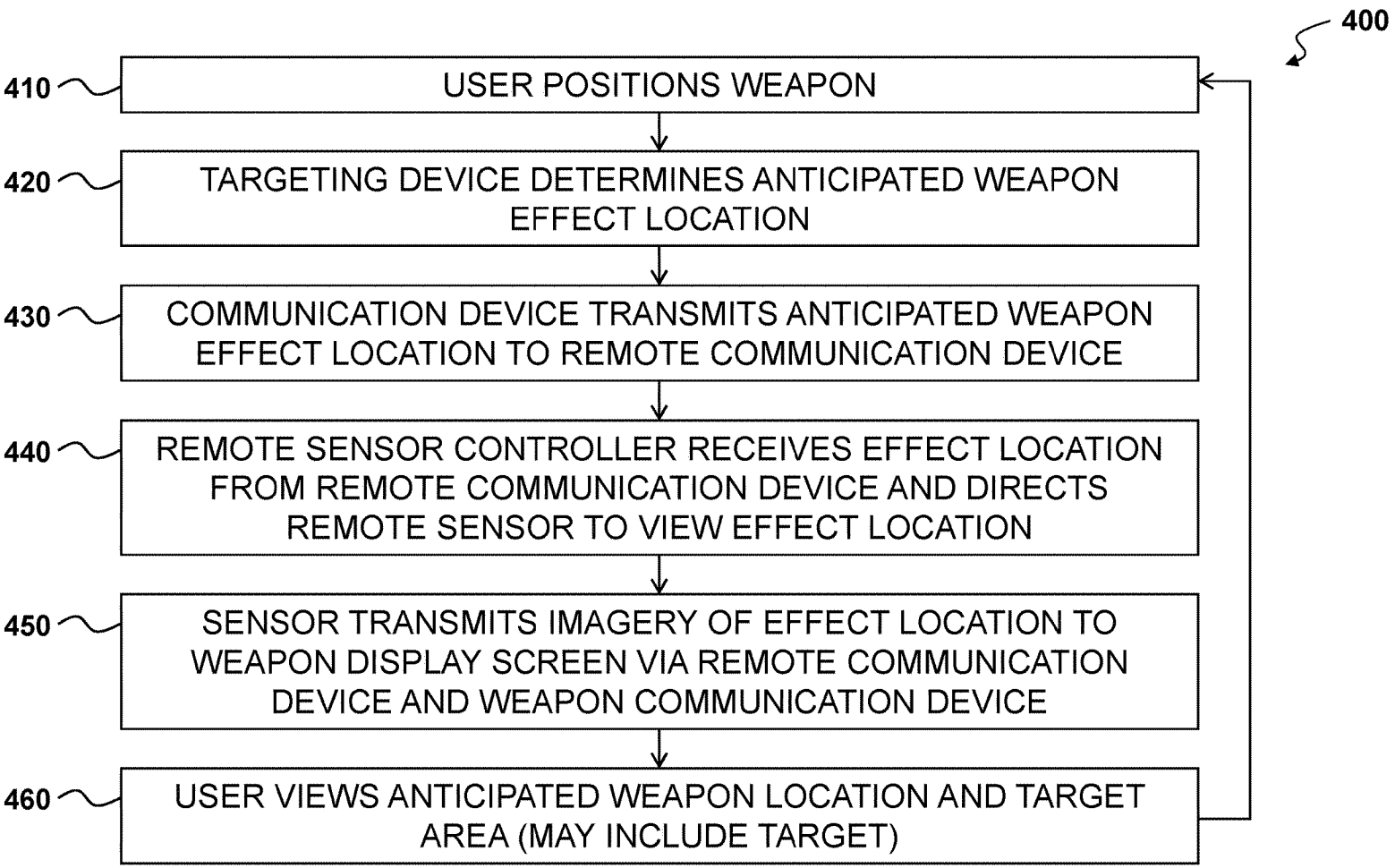
FIG. 4 is a flowchart of an exemplary embodiment of the weapon targeting system.

FIG. 4 is a flowchart of an exemplary embodiment of the weapon targeting system 400. The method depicted in the diagram includes the steps of: The Weapon is placed in position, for example, by a user (step 410); Targeting Device Determines the Anticipated Weapon Effect Location (step 420); the Communication Device Transmits the Anticipated Weapon Effect Location to the Remote Communication Device (step 430); The Remote Sensor Controller Receives the Effect Location from the Remote Communication Device and Directs the Remote Sensor to the Effect Location (step 440); The Sensor Transmits Imagery of the Effect Location to the Weapon Display Screen via the Remote Communication Device and the Weapon Communication Device (step 450); and The User Views the Anticipated Weapon Effect Location and Target Area (may include a target) (step 460). The effect location may be the calculated, predicted, or expected impact point with or without an error. After the step 460 the process may start over at step 410. In this manner a user may aim the weapon and adjust the fire on to a target based on the previous received imagery of effect location. In one embodiment, step 450 may include rotating the image so to align the image with the direction of the weapons to aid the user in targeting.

Figure 5:
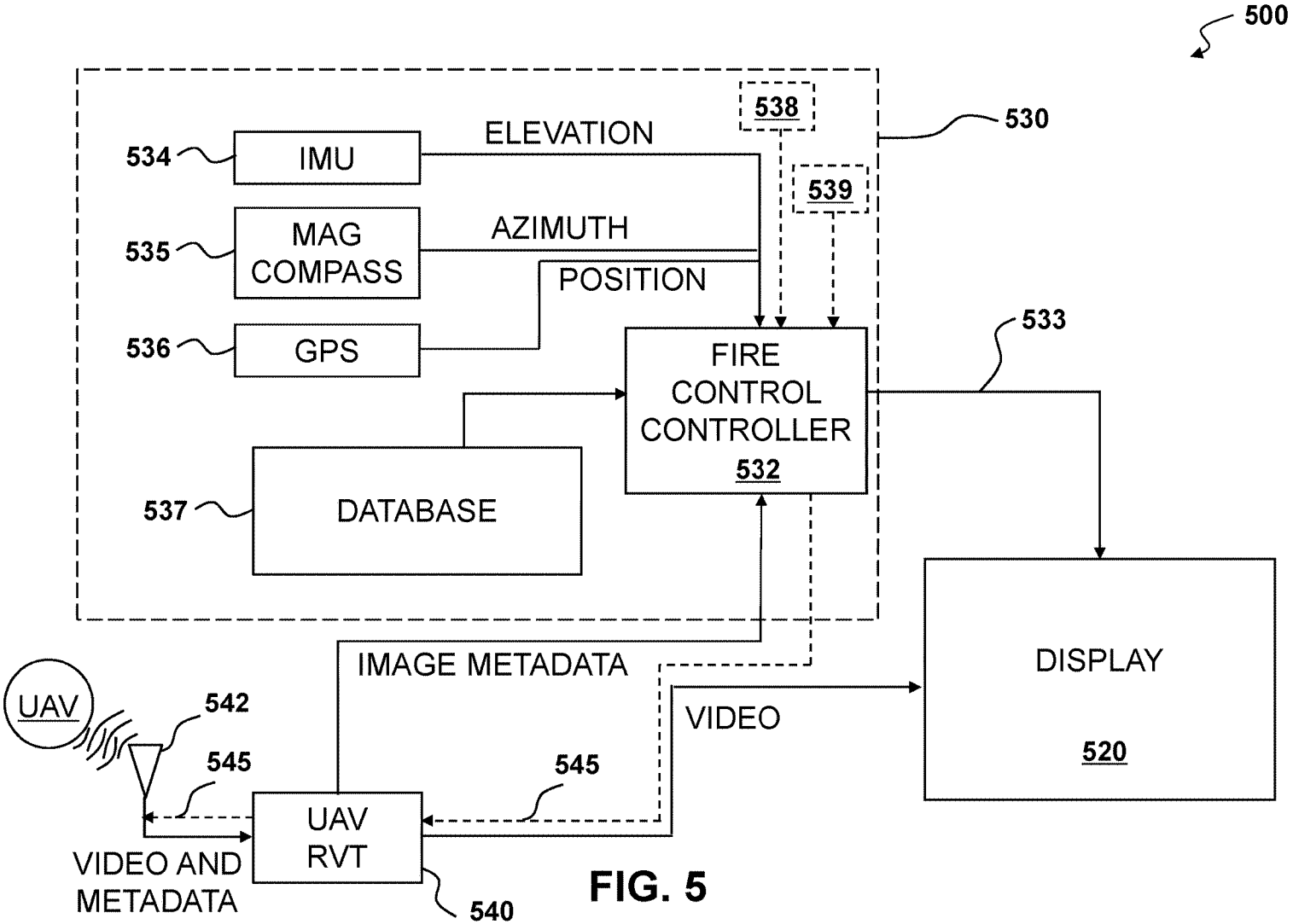
FIG. 5 is a functional block diagram depicting an exemplary weapon targeting system.

FIG. 5 depicts a functional block diagram of a weapon targeting system 500 where the system includes a display 520, a targeting device 530, a UAV remote video terminal 540, and an RF receiver 542. The display 520 and targeting device 530 may be detachably attached or mounted on, or operating with, a gun or other weapon (not shown). The display 520 may be visible to the user of the weapon to facilitate targeting and directing fire. The targeting device 530, may include a fire control controller 532, the fire control controller having a processor and addressable memory, an IMU 534, a magnetic compass 535, a GPS 536, and a ballistic data on gun and round database 537. The IMU 534 generates the elevation position, or angle from level, of the weapon and provides this information to the fire control controller 532. The magnetic compass 535 provides the azimuth of the weapon to the controller 532, such as the compass heading that the weapon is aimed toward. The GPS 536 provides the location of the weapon to the fire control controller 532, which typically includes the longitude, latitude, and altitude (or elevation). The database 537 provides to the fire control controller 532 ballistic information on both the weapon and on its round (projectile). The database 537 may be a lookup table, one or more algorithms, or both, however typically a lookup table is provided. The fire control controller 532 may be in communication with the IMU 534, the compass 535, the GPS 536, and database 537.

In addition, the fire control controller 532 may use the weapon's position and orientation information from the components IMU 534, the compass 535, the GPS 536 to process with the weapon and round ballistics data from the database 537 and to determine an estimated or predicted ground impact point (not shown). In some embodiments, the controller 532 may use the elevation of the weapon from the IMU 534 to process through a lookup table of database 537, with a defined type of weapon and round, to determine the predicted range or distance from the weapon the round will travel to the point of impact with the ground. The type of weapon and round may be set by the user of the weapon prior to the operation of the weapon, and in embodiments, the round selection may change during the use of the weapon. Once the distance is determined, the fire control controller 532 may use the weapon position from the GPS 536 and the weapon azimuth from the compass 535 to determine a predicted impact point. In addition, the computer 532 may use the image metadata from the UAV received from the RF receiver 542 or UAV remote video terminal (RVT) 540, where the metadata may include the ground position of the CFOV of the remote sensor, e.g., optical camera (not shown), and may include the ground position of some or all of the corners of the video image transmitted back to the system 500. The fire control controller 532 may then use this metadata and the predicted impact point to create an icon overlay 533 to be shown on the display 520. This overlay 533 may include the positioning of the CFOV and the predicted impact point B.

Exemplary embodiments of the fire control controller 532 may use error inputs provided by the aforementioned connected components to determine and show on the display 520 an error area (such as an ellipse) about the predicted impact point. In one embodiment, the fire control controller 532 may also transmit the predicted impact GP 545 to the UAV via the RF transmitter 542 and its associated antenna to direct the remote sensor on the UAV where to point and capture images. In one embodiment, the fire control controller 532 may send a request to an intermediary where the request includes a target point where the operator of the fire control controller 532 desires to view and requests to receive imagery from the sensor on the UAV.

Additionally, in some embodiments, the fire control controller 532 may also include input from a map database 538 to determine the predicted impact GP. Accuracy of the predicted impact GP may be improved by use of map database in situations such as when the weapon and the predicted impact GP are positioned at different altitudes or ground heights. Another embodiment may include environmental condition data 539 that may be received as input and used by the fire control controller 532. The environmental condition data 539 may include wind speeds, air density, temperature, and the like. In at least one embodiment, the fire control controller 532 may calculate round trajectory based on the state estimate of the weapon, as provided by the IMU and environmental conditions, such as wind estimate received from the UAV.

Figure 6:
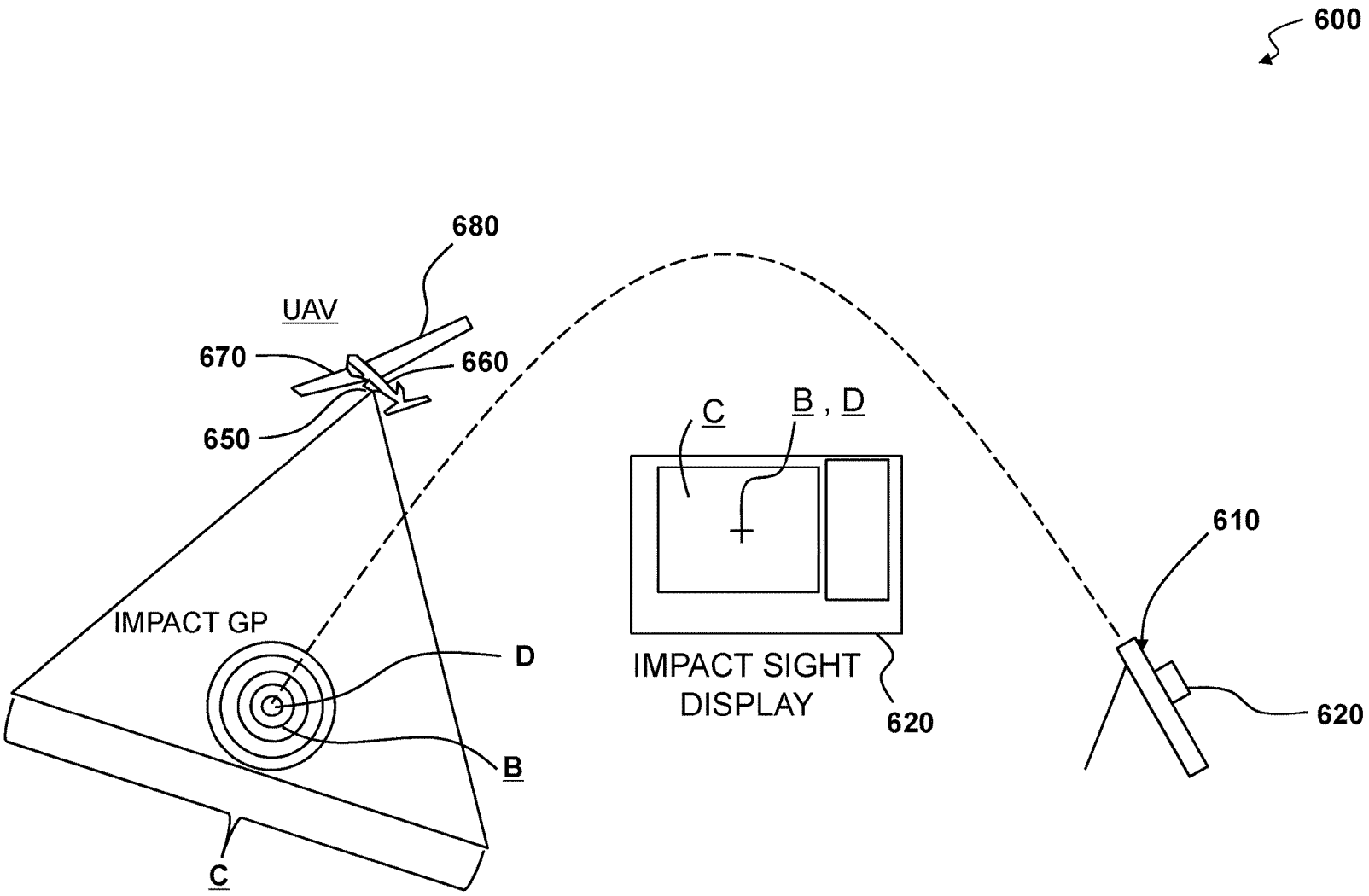
FIG. 6 shows an embodiment of the weapon targeting system having a weapon with a display or sight which views a target area about a predicted impact ground point (GP) and centered on a Center Field of View.

FIG. 6 shows an embodiment of the weapon targeting system 600 having a weapon 610, for example, mortar, gun, or grenade launcher, with a display or sight 620 which views a target area C about a predicted impact GP B and centered on a CFOV D as viewed by an UAV 680 having a gimbaled camera 650. The UAV 680 includes a gimbaled camera controller 670 that directs the camera 650 to the predicted impact GP B received by the transmitter/receiver 660 from the weapon 610. In one embodiment, the UAV may provide an electro-optical (EO) and infrared (IR) full-motion video (EO/IR) imagery with the CFOV. That is, the transmitter/receiver 660 may send video from the sensor or camera 650 to the display 620. In embodiments of the weapon targeting system there may be two options for the interaction between the weapon and the remote sensor, active control of the sensor or passive control of the sensor. In an exemplary embodiment of the active control, the gun or weapon position may control the sensor or camera where the camera slews to put the CFOV on the impact site and further, the camera provides controls for actual zooming functions. In the exemplary embodiment of the passive control, the UAV operator may control the sensor or camera and accordingly, the impact site may only appear when it is within the field of view of the camera. In this passive control embodiment, the zooming capabilities of the camera are not available; however, compressed data received from the camera (or other video processing) may be used for zooming effects.

In embodiments with active control, the operator of the weapon has supervised control of the sensor. The targeting system sends the predicted impact ground point (GP) coordinates to the remote sensor controller (which may be done in any of a variety of message formats, including as a Cursor on Target (CoT) message). The remote sensor controller uses predicted impact GP as a command for the CFOV for the camera. The remote sensor controller then centers the camera on that predicted impact GP. In the case of an existing lag time between when the weapon positioning and when the sensor slews to center its view on the predicted impact point, the targeting device, e.g., fire control controller, will gray out the reticle, e.g., cross-hairs, on the displayed image until the CFOV is actually aligned with the predicted impact GP and it will display the predicted impact GP on the image as it moves toward the CFOV. In some embodiments, the barrel orientation of a weapon may then effect a change in the movement of the Center Field of View of the UAV thereby allowing the operator of the weapon to quickly seek and identify multiple targets at they appear on the impact sight display 620.

Figure 7:
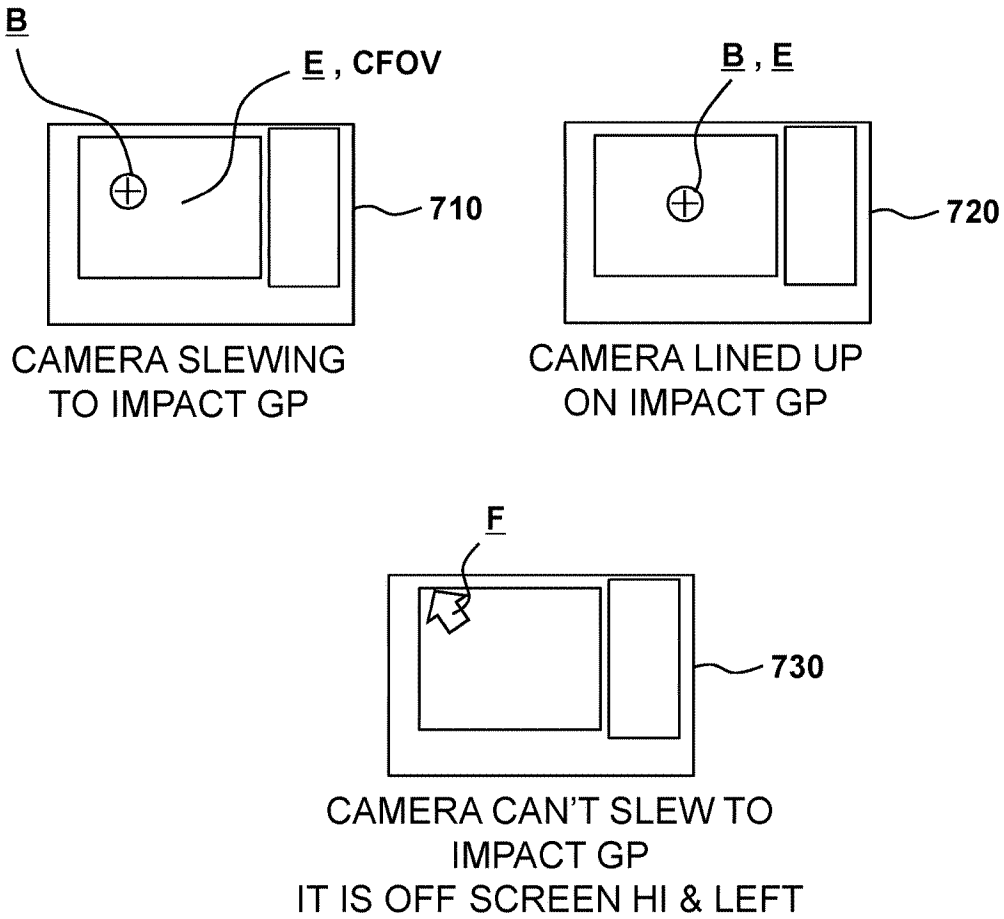
FIG. 7 shows embodiments of the weapon targeting system where the targeting system is configured to control the remote camera on the UAV.

FIG. 7 shows embodiments of the weapon targeting system where the targeting system is configured to control the remote camera on the UAV. The display 710 shows the predicted impact GP B to the left and above the CFOV E in the center of the view. In the display 710 the camera is in the process of slewing towards the predicted impact point GP. In the display 720 the predicted impact GP B is now aligned with the CFOV E in the center of the view of the image. The display 730 shows a situation when the predicted impact GP B is outside of the field of view of the camera, namely above and left of the image shown. In this case either the sensor or camera has not yet slewed to view the GP B or it is not capable of doing so. This may be due to factors such as limits in the tilt and/or roll of the sensor gimbal mount. In one embodiment, the display 730 shows an arrow F, or other symbols, where the arrow may indicate the direction toward the location of the predicted impact GP B. This allows the user to obtain at least a general indication of where he or she is aiming the weapon.

In embodiments with passive control, the weapon user may have view of an image from the remote sensor, but has no control over the remote sensor or the UAV or other means carrying the remote sensor. The weapon user may see the imagery from the remote sensor, including an overlay projected onto the image indicating where the predicted impact GP is located. If the predicted impact GP is outside the field of view of the camera, an arrow at the edge of the image will indicate which direction the computed impact point is relative to the image (such as is shown in the display 730). In such embodiments the user may move the weapon to position the predicted impact ground point within the view and/or may request that the UAV operator to redirect the remote sensor and/or the UAV to bring the predicted impact GP into view. In this embodiment, the weapon user operating the system in the passive control mode may have control of the zoom of the image to allow for the facilitating of location and maneuvering of the predicted impact GP. It should be noted that embodiment of passive control may be employed when there is more than one weapon system using the same display imagery, e.g., from the same remote camera, to direct the targeting of each of the separate weapons. Since calculation of the predicted impact point is done at the weapon, with the targeting system or fire control computer, given the coordinates of the imagery (CFOV, corners), the targeting system may generate the user display image without needing to send any information to the remote sensor. That is, in a passive mode there is no need to send the remote camera the predicted impact GP as the remote sensor is never directed towards that GP.

Figure 8:
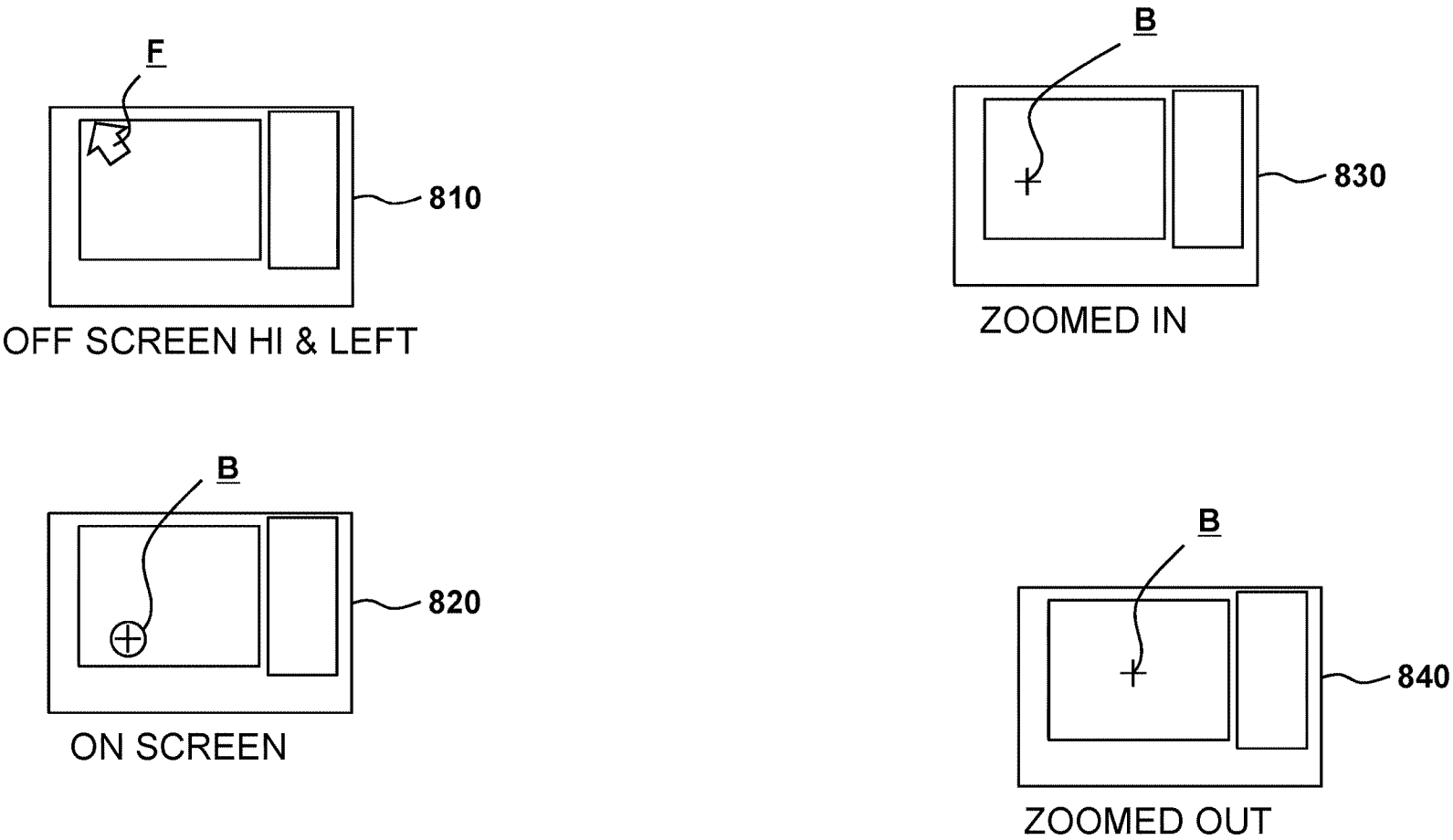
FIG. 8 shows a set of exemplary displays of an embodiment of the weapon targeting system with passive control sensor/UAV control.

FIG. 8 shows displays of an embodiment of the weapon targeting system with passive control sensor/UAV control. The display 810 shows the predicted impact GP B outside of the field of view of the camera, namely above and left of the image shown. In this case either the camera hasn't yet slewed to view the GP B or it is not capable of doing so—due to factors such as limits in the tilt and/or roll of the sensor gimbal mount. In one embodiment, the display 810 shows an arrow E or other symbol, indicating the direction to the location of the predicted impact GP B. This allows the user to obtain at least a general indication of where he or she is aiming the weapon. The display 820 shows the predicted impact GP B to the left and below the CFOV. While the GP B may be moved within the image of the display 820 by maneuvering the weapon—since the remote sensor control is passive—the sensor may not be directed to move the CFOV to align with the GP B. The displays 830 and 840 show an embodiment where the user has control over zooming of the camera, zoomed in and zoomed out, respectfully.

Figure 9:
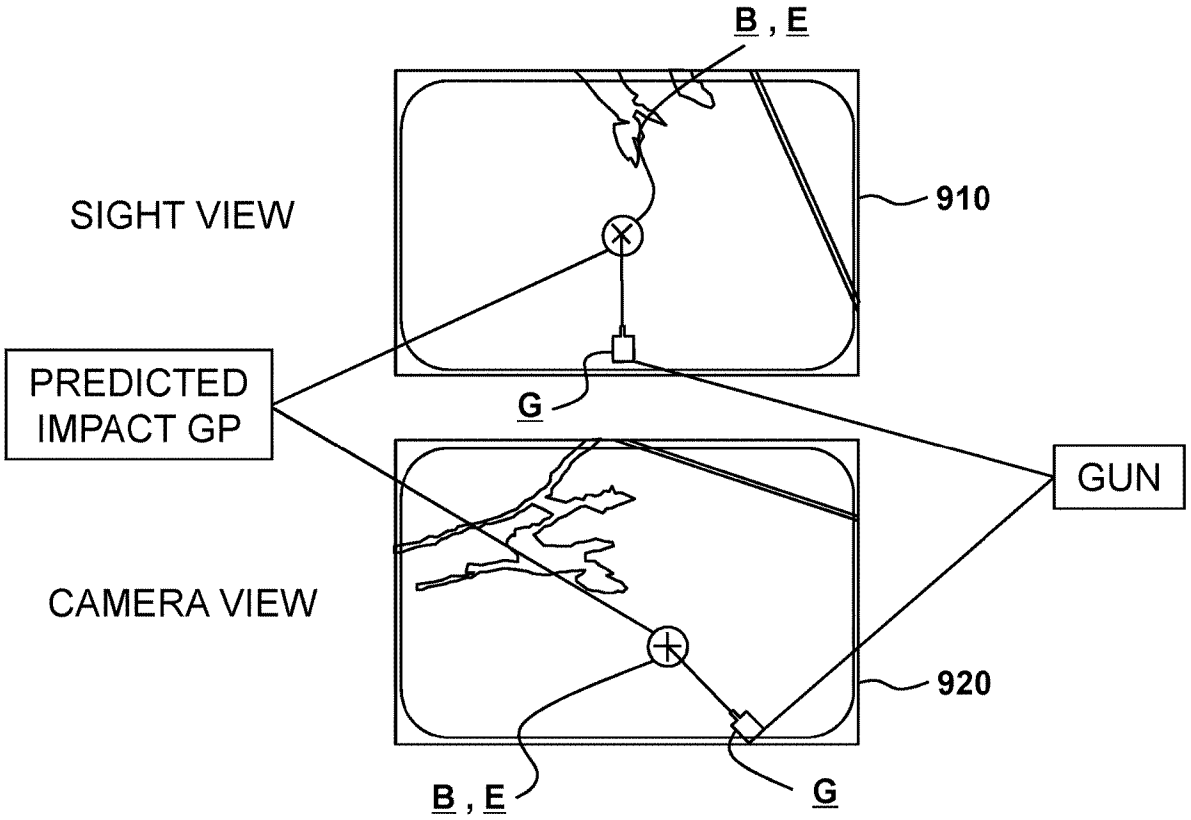
FIG. 9 shows embodiments where the image from the remote sensor is rotated or not rotated to the weapon user's perspective.

FIG. 9 shows embodiments where the image from the remote sensor is rotated or not rotated to the weapon user's perspective, namely the orientation of the weapon. The display 910 shows the imagery rotated to the orientation of the weapon and shows the predicted impact GP B, the CFOV E and the weapon location G. The display 920 shows the imagery not rotated to the orientation of the weapon and shows the predicted impact GP B, the CFOV E and the weapon location G. In one embodiment of the passive mode, the display may still be rotated to the orientation of the target to the weapon, i.e., not where the weapon is pointed. In this case, the weapon location G would still be at the bottom of the display, but the predicted impact GP B would not be CFOV.

In some embodiments, the system may include either, or both, multiple weapons and/or multiple remote sensors. Multiple weapon embodiments have more than one weapon viewing the same imagery from a single remote sensor with each weapon system displaying its own predicted impact GP. In this manner, several weapons may be coordinated to work together in targeting the same or different targets. In these embodiments, one of the weapons may be in active control of the remote sensor/UAV, with the others in passive mode. Also, each targeting device of each weapon may provide to the UAV its predicted impact GP and the remote sensor may then provide, to all the targeting devices of all the weapons, each of the predicted impact GPs of the weapons in its metadata. This way, with the metadata for each of the targeting devices, the metadata may be included in the overlay of each weapon display. This metadata may include an identifier for the weapon and/or the weapon location.

Figure 10:
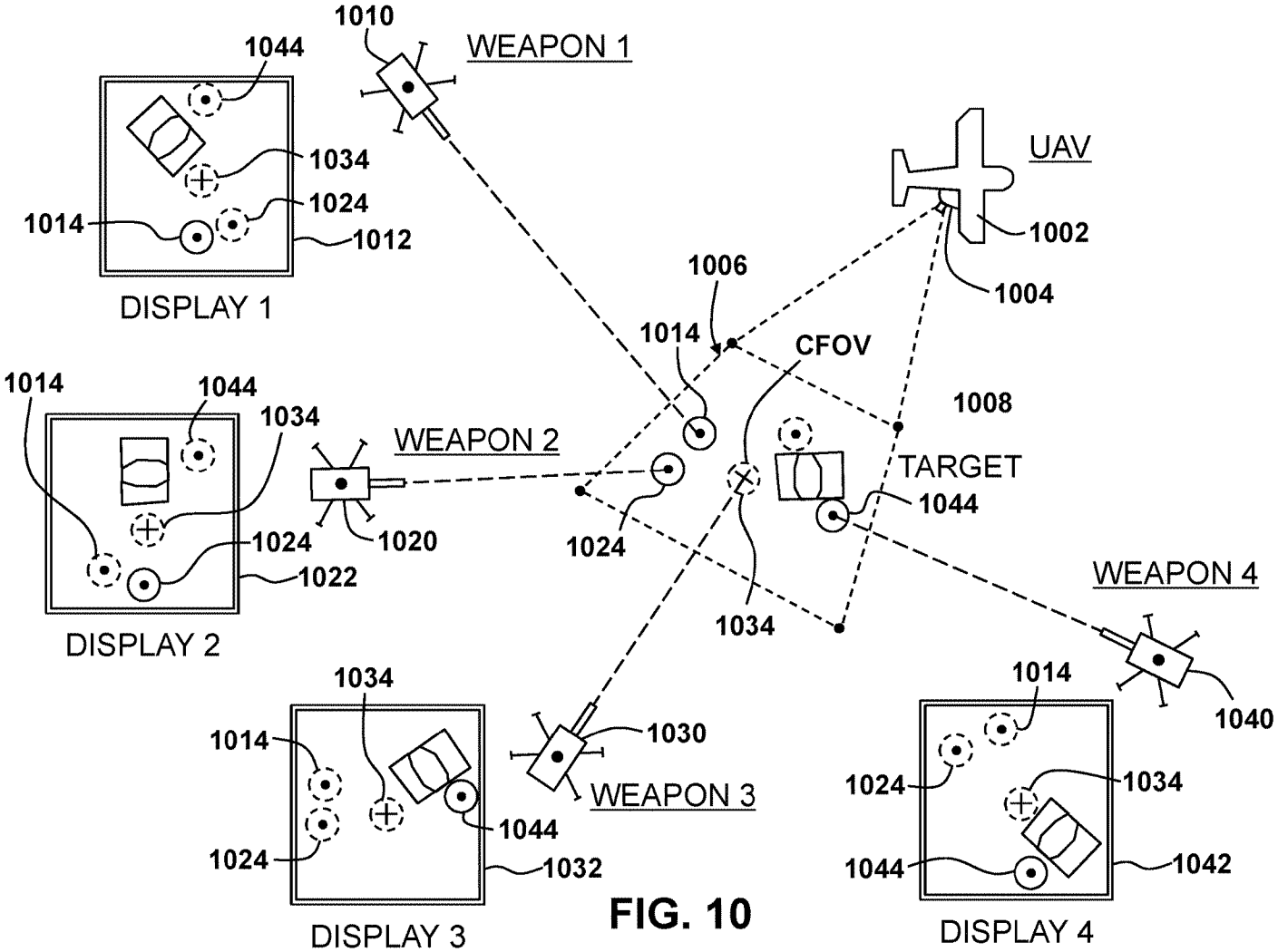
FIG. 10 depicts an exemplary embodiment of the weapon targeting system that may include multiple weapons receiving imagery from one remote sensor.

FIG. 10 depicts an exemplary embodiment of the weapon targeting system that may include multiple weapons receiving imagery from one remote sensor. The UAV 1002 may have a gimbaled camera 1004 that views a target area with the image boundary 1006 and image corners 1008. The center of the image is a CFOV. The weapon 1010 has a predicted impact GP 1014 as shown on the display 1012 with the CFOV. The weapon 1020 may have a predicted impact GP 1024 as shown on the display 1022 with the CFOV. The weapon 1030 may have a predicted impact GP 1034 at the CFOV as shown on the display 1032. The CFOV may then be aligned with the GP 1034 in embodiments where the weapon 1030 is in an active control mode of the remote sensor/UAV. The weapon 1040 has a predicted impact GP 1044 as shown on the display 1042 with the CFOV. In embodiments where the predicted impact GPs of each weapon are shared with the other weapons, either via the UAV or directly, each weapon may display the predicted impact GPs of the other weapons. In one embodiment, an operator of the UAV 1002 may use the imagery received from the gimbaled camera 1004 to determine which weapon, for example, of a set of weapons 1010,1020,1030,1040, may be in the best position to engage the target in view of their respective predicted impact GPs 1044.

In some embodiments, the most effective weapon may be utilized based on the imagery received from one remote sensor and optionally, a ballistic table associated with the rounds. Accordingly, a dynamic environment may be created where different weapons may be utilized for a target where the target and the predicted impact GP are constantly in flux. The control may be dynamically shifted between the gun operator, a UAV operator, and or a control commander, where each operator may have been in charge of a different aspect of the weapon targeting system. That is, the control or command of a UAV or weapon may be dynamically shifted from one operator to another. Additionally, the system may allow for an automated command of the different weapons and allow for the synchronization of multiple weapons based on the received imagery and command controls from the sensor on the UAV.

In some embodiments, one weapon may utilize multiple remote sensors, where the weapon display would automatically switch to show the imagery from the remote sensor either showing the predicted impact GP, or with the GP off screen, or with the GP on multiple image feeds, to show the imagery closest to the predicted impact GP. This embodiment utilizes the best view of the predicted impact GP. Alternatively, with more than one remote sensor viewing the predicted impact GP, the weapon user may switch between imagery to be display or display each image feed on its display, e.g., side-by-side views.

Figure 11:
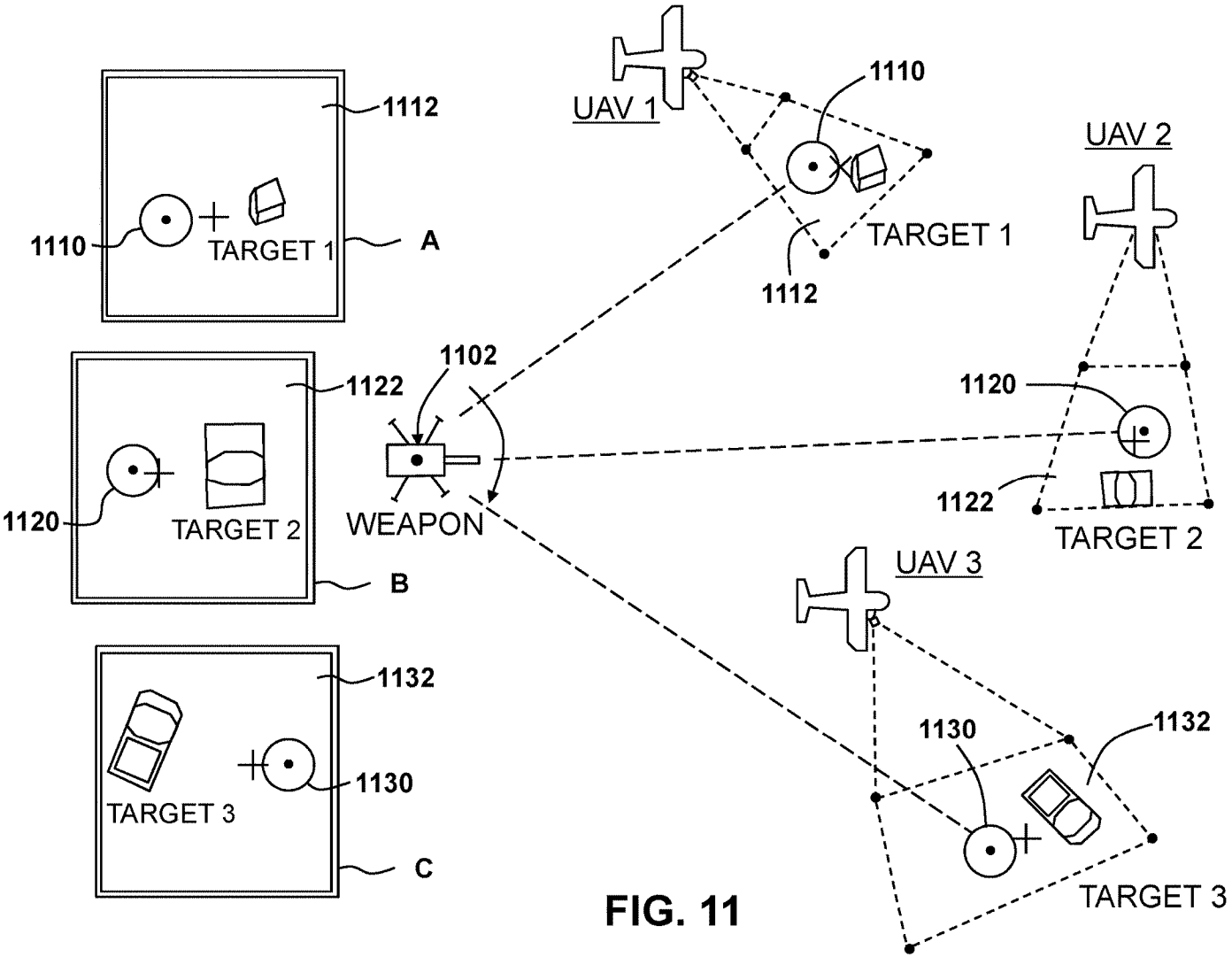
FIG. 11 depicts a scenario where as the weapon is maneuvered by the user, the predicted impact GP of the weapon passes through different areas.

FIG. 11 depicts a scenario where as the weapon 1102 is maneuvered by the user, the predicted impact GP of the weapon passes through different areas—as observed by separate remote sensors. The weapon display may automatically switch to the imagery of the remote sensor that the weapon's predicted GP is located within. With the weapon's predicted impact GP 1110 within the viewed area 1112 of the remote camera of UAV 1, the display may show the video image A from UAV 1. Then as the weapon is maneuvered to the right, as shown, with the weapon's predicted impact GP 1120 within the viewed area 1122 of the remote camera of UAV 2, the display will show the video image B from UAV 2. Lastly, as the weapon is further maneuvered to the right, as shown, with the weapon's predicted impact GP 1130 within the viewed area 1132 of the remote camera of UAV 3, the display will show the video image C from UAV 3.

Figure 12:
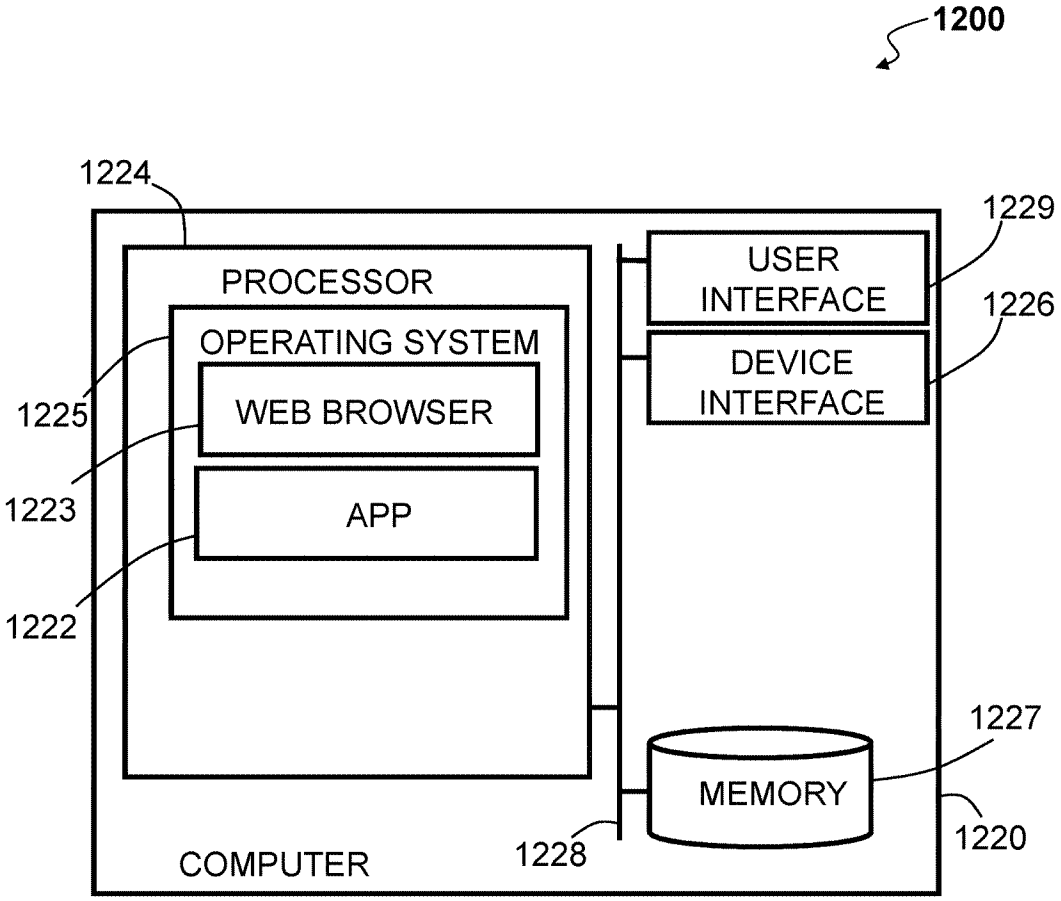
FIG. 12 illustrates an exemplary top level functional block diagram of a computing device embodiment.

FIG. 12 illustrates an exemplary top level functional block diagram of a computing device embodiment 1200. The exemplary operating environment is shown as a computing device 1220, i.e., computer, having a processor 1224, such as a central processing unit (CPU), addressable memory 1227 such as a lookup table, e.g., an array, an external device interface 1226, e.g., an optional universal serial bus port and related processing, and/or an Ethernet port and related processing, an output device interface 1223, e.g., web browser, an application processing kernel 1222, and an optional user interface 1229, e.g., an array of status lights, and one or more toggle switches, and/or a display, and/or a keyboard, joystick, trackball, or other position input device and/or a pointer-mouse system and/or a touch screen. Optionally, the addressable memory may, for example, be: flash memory, SSD, EPROM, and/or a disk drive and/or another storage medium. These elements may be in communication with one another via a data bus 1228. In an operating system 1225, such as one supporting an optional web browser and applications, the processor 1224 may be configured to execute steps of a fire control controller in communication with: an inertial measurement unit, the inertial measurement unit configured to provide elevation data to the fire control controller; a magnetic compass, the magnetic compass operable to provide azimuth data to the fire control controller; a global positioning system (GPS) unit, the GPS unit configured to provide position data to the fire control controller; a data store, the data store having ballistic information associated with a plurality of weapons and associated rounds; and where the fire control controller determines a predicted impact point of a selected weapon and associated round based on the stored ballistic information, the provided elevation data, the provided azimuth data, and the provided position data. In one embodiment, a path clearance check may be performed by the fire control controller where it provides the ability to not fire a round if the system detects that there is or will be an obstruction on the path of the weapon if fired.

It is contemplated that various combinations and/or subcombinations of the specific features and aspects of the above embodiments may be made and still fall within the scope of the invention. Accordingly, it should be understood that various features and aspects of the disclosed embodiments may be combined with or substituted for one another in order to form varying modes of the disclosed invention. Further it is intended that the scope of the present invention is herein disclosed by way of examples and should not be limited by the particular disclosed embodiments described above.

What is claimed is:

1. A device comprising:

a fire control controller, wherein the fire control controller determines a predicted impact point of a selected weapon and associated round, and wherein the fire control controller transmits information on the predicted impact point to a sensor controller on an aerial vehicle housing a remote sensor to direct the pointing of the remote sensor of the aerial vehicle.

2. The device of claim 1, wherein the pointing of the remote sensor of the aerial vehicle is based on the predicted impact point of the selected weapon.

3. The device of claim 2, wherein the predicted impact point is based on at least one of: ballistic information, elevation data, azimuth data, and position data.

4. The device of claim 3 further comprising:

a data store in communication with the fire control controller, the data store having stored the ballistic information associated with a plurality of weapons and associated rounds.

5. The device of claim 3 further comprising:

a navigation unit in communication with the fire control controller, the navigation unit configured to provide the position data to the fire control controller.

6. The device of claim 3 further comprising:

a magnetic compass in communication with the fire control controller, the magnetic compass operable to provide the azimuth data to the fire control controller.

7. The device of claim 3 further comprising:

a navigation unit in communication with the fire control controller, the navigation unit configured to provide the position data to the fire control controller.

8. The device of claim 1 wherein the fire control controller determines the predicted impact point based on predicting a distance associated with the selected weapon, wherein the distance is the distance between a current location of the rounds of the weapon and a point of impact with the ground.

9. The device of claim 1 further comprising:

an environmental condition determiner in communication with the fire control controller, wherein the environmental condition determiner is configured to provide information related to environmental conditions of the surrounding areas of the predicted impact point in order for the fire control controller to determine the predicted impact point, and wherein the fire control controller determines the predicted impact point based on the environmental condition information.

10. The device of claim 1 further comprising:

a ballistic range determiner in communication with the fire control controller, wherein the ballistic range determiner is configured to determine the predicted impact point based on the weapon position, azimuth, elevation, and round type.

11. The device of claim 1, wherein the fire control controller receives image metadata from the remote sensor and wherein the image metadata comprises a ground position of a Center Field of View (CFOV) of the remote sensor, and wherein the CFOV is directed at the predicted impact point.

12. The device of claim 1, wherein the aerial vehicle is an unmanned aerial vehicle (UAV).

13. A method comprising:

determining, by a fire control controller, a predicted impact point of a selected weapon and associated round; and transmitting, by the fire control controller, information on the predicted impact point to a sensor controller on an aerial vehicle housing a remote sensor to direct the pointing of the remote sensor of the aerial vehicle.

14. The method of claim 13, further comprising:

receiving, by the sensor controller of the aerial vehicle, the transmitted information on the predicted impact point; and directing, by the sensor controller, the pointing of the remote sensor of the aerial vehicle based on the received predicted impact point.

15. The method of claim 13, wherein the predicted impact point is based on at least one of: ballistic information, elevation data, azimuth data, and position data.

16. The method of claim 15 further comprising:

providing, by a data store in communication with the fire control controller, the ballistic information associated with the selected weapon and associated round to the fire control controller.

17. The method of claim 15 further comprising:

providing, by a navigation unit in communication with the fire control controller, the position data to the fire control controller.

18. The method of claim 15 further comprising:

providing, by a magnetic compass in communication with the fire control controller, the azimuth data to the fire control controller.

19. The method of claim 15 further comprising:

providing, by a navigation unit in communication with the fire control controller, the position data to the fire control controller.

20. The method of claim 13 further comprising:

transmitting, by the sensor controller, a video of the predicted impact point from the remote sensor of the aerial vehicle; and displaying, via a display device in communication with the fire control controller, the transmitted video of the predicted impact point.

* * * * *